US009144999B2

(12) United States Patent
Lakin

(10) Patent No.: US 9,144,999 B2
(45) Date of Patent: Sep. 29, 2015

(54) TAPE DRIVE AND METHOD OF OPERATION OF A TAPE DRIVE

(71) Applicant: Markem-Imaje Limited, Nottingham (GB)

(72) Inventor: Phillip Lakin, Woodthorpe (GB)

(73) Assignee: Dover Europe Sàrl, Vernier (CH)

( * ) Notice: Subject to any disclaimer, the term of this patent is extended or adjusted under 35 U.S.C. 154(b) by 0 days.

(21) Appl. No.: 14/075,935

(22) Filed: Nov. 8, 2013

(65) Prior Publication Data

US 2014/0132698 A1 May 15, 2014

(30) Foreign Application Priority Data

Nov. 9, 2012 (GB) ..... 1220180.2

(51) Int. Cl.

| | |
|---|---|
| ***B41J 33/00*** | (2006.01) |
| ***B41J 33/34*** | (2006.01) |
| ***B41J 2/315*** | (2006.01) |
| ***B41J 35/36*** | (2006.01) |
| ***B41J 31/16*** | (2006.01) |
| ***B65H 23/04*** | (2006.01) |
| *B41J 33/14* | (2006.01) |
| *B65H 23/182* | (2006.01) |

(Continued)

(52) U.S. Cl.

CPC *B41J 2/315* (2013.01); *B41J 31/16* (2013.01); *B41J 35/36* (2013.01); *B65H 23/044* (2013.01); *B41J 33/14* (2013.01); *B65H 23/18* (2013.01); *B65H 23/1825* (2013.01); *B65H 23/1955* (2013.01)

(58) Field of Classification Search

USPC ..... 347/215, 218, 217; 400/223, 225, 232, 400/234

See application file for complete search history.

(56) References Cited

U.S. PATENT DOCUMENTS

| | | | |
|---|---|---|---|
| 4,924,240 | A | 5/1990 | Herbert |
| 5,254,924 | A | 10/1993 | Ogasawara |

(Continued)

FOREIGN PATENT DOCUMENTS

| | | | |
|---|---|---|---|
| EP | 745890 | A1 | 12/1996 |
| EP | 947345 | A3 | 3/2000 |

(Continued)

OTHER PUBLICATIONS

U.S. Appl. No. 14/179,832, Office Action Summary mailed Dec. 16, 2014, 18 pages.

(Continued)

*Primary Examiner* — Huan Tran

(74) *Attorney, Agent, or Firm* — Fish & Richardson P.C.

(57) ABSTRACT

A method of detecting a reduction in tension in a tape, wherein the tape is transferable between a first spool (15) and a second spool (17) by a tape drive (11), the tape drive (11) having a motor control system (25) which includes two DC motors (16, 18) and a controller (24) for controlling the operation of the motors (16, 18), the tape drive (11) also having two spool supports (12, 14), each of which is suitable for supporting a spool (15, 17) of tape, and each of which is driven by a respective one of the motors (16, 18), the method including storing a value relating to the current required to be supplied to each motor (16, 18) to maintain tension in the tape, and comparing a value relating to the current being supplied to each of the motors (16, 18) during tape transfer with the respective stored values.

17 Claims, 6 Drawing Sheets

(51) Int. Cl.
*B65H 23/18* (2006.01)
*B65H 23/195* (2006.01)

(56) References Cited

U.S. PATENT DOCUMENTS

| | | | | |
|---|---|---|---|---|
| 5,325,115 | A | 6/1994 | Tanahashi | |
| 5,614,803 | A | 3/1997 | Morioka | |
| 5,751,331 | A | 5/1998 | Higuchi et al. | |
| 5,908,251 | A | 6/1999 | Buckby | |
| 5,921,689 | A | 7/1999 | Buckby | |
| 5,975,777 | A | 11/1999 | Nelson | |
| 6,068,206 | A | 5/2000 | Lindsay | |
| 6,082,914 | A * | 7/2000 | Barrus et al. | 400/234 |
| 6,305,629 | B1 * | 10/2001 | Chliwnyj et al. | 242/334.3 |
| 6,757,129 | B2 | 6/2004 | Kuroiwa | |
| 6,975,087 | B1 | 12/2005 | Crabill | |
| 7,150,572 | B2 * | 12/2006 | McNestry et al. | 400/223 |
| 7,682,094 | B2 | 3/2010 | McNestry | |
| 7,722,268 | B2 | 5/2010 | McNestry | |
| 7,748,917 | B2 | 7/2010 | McNestry | |
| 7,753,605 | B2 | 7/2010 | McNestry | |
| 8,007,190 | B2 | 8/2011 | McNestry | |
| 8,096,715 | B2 | 1/2012 | McNestry | |
| 8,221,009 | B2 | 7/2012 | McNestry | |
| 8,221,010 | B2 | 7/2012 | McNestry | |
| 8,317,421 | B2 * | 11/2012 | McNestry | 400/234 |
| 8,328,441 | B2 | 12/2012 | McNestry | |
| 8,591,127 | B2 | 11/2013 | McNestry | |
| 8,730,287 | B2 * | 5/2014 | Bouverie et al. | 347/217 |
| 8,770,874 | B2 * | 7/2014 | McNestry et al. | 400/236 |
| 2003/0049065 | A1 * | 3/2003 | Barrus et al. | 400/223 |
| 2004/0146331 | A1 * | 7/2004 | McNestry et al. | 400/615.2 |
| 2008/0217454 | A1 | 9/2008 | Trago | |
| 2008/0219740 | A1 | 9/2008 | McNestry | |
| 2008/0219741 | A1 | 9/2008 | McNestry | |
| 2008/0219742 | A1 | 9/2008 | McNestry | |
| 2008/0219743 | A1 * | 9/2008 | McNestry et al. | 400/234 |
| 2009/0302143 | A1 | 12/2009 | Bayang | |
| 2009/0309949 | A1 | 12/2009 | Fukutani | |
| 2010/0089962 | A1 * | 4/2010 | Mehlis et al. | 226/1 |
| 2010/0172682 | A1 | 7/2010 | Hart | |
| 2013/0039685 | A1 | 2/2013 | Starkey | |
| 2013/0215210 | A1 * | 8/2013 | McNestry et al. | 347/214 |

FOREIGN PATENT DOCUMENTS

| | | | |
|---|---|---|---|
| EP | 1055521 | A3 | 5/2003 |
| FR | 2783459 | A1 | 3/2000 |
| GB | 1550218 | A | 8/1979 |
| GB | 2022018 | A | 12/1979 |
| GB | 2289441 | A | 11/1995 |
| GB | 2310405 | A | 8/1997 |
| GB | 2448302 | A | 10/2008 |
| GB | 2449676 | A | 12/2008 |
| GB | 2478725 | A | 9/2011 |
| GB | 2493541 | A | 2/2013 |
| JP | 62087382 | A | 4/1987 |
| JP | 04339680 | A | 11/1992 |
| JP | 04347659 | A | 12/1992 |
| JP | 6312568 | A | 11/1994 |
| JP | 8002078 | A | 1/1996 |
| JP | 8067045 | A | 3/1996 |
| JP | 9001906 | A | 1/1997 |
| WO | WO0222371 | A2 | 3/2002 |
| WO | WO03029013 | A1 | 4/2003 |
| WO | W02008107647 | A1 | 9/2008 |
| WO | WO2008107642 | A1 | 9/2008 |
| WO | WO2008107650 | A1 | 9/2008 |
| WO | WO2013021211 | A3 | 4/2013 |

OTHER PUBLICATIONS

U.S. Appl. No. 14/179,483, Office Action Summary mailed Dec. 5, 2014, 17 pages.
U.S. Appl. No. 14/179,145, Office Action Summary mailed Apr. 3, 2015, 18 pages.
U.S. Appl. No. 13/237,802, Office Action Summary mailed Jan. 2, 2014, 19 pages.
U.S. Appl. No. 13/237,802, Response to Action of Jan. 2, 2014, filed Apr. 2, 2014, 14 pages.
U.S. Appl. No. 13/237,802, Final Office Action Summary mailed Jul. 24, 2014, 23 pages.
U.S. Appl. No. 13/237,802, Reply to Action of Jul. 24, 2014, filed Sep. 24, 2014, 9 pages.
U.S. Appl. No. 13/237,802, Reply to Action of Jul. 24, 2014, filed Dec. 19, 2014, 9 pages.
U.S. Appl. No. 13/237,802, Office Action Summary mailed Jan. 20, 2015, 17 pages.
Intellectual Property Office, Search Report dated Jan. 17, 2012, GB Application No. GB1113777.5, 3 pages.
Authorized Officer Athina Nickitas-Etienne, International Preliminary Report on Patentability, International Application No. PCT/GB2012/051954, issued Feb. 11, 2014, 5 pages.
Communication pursuant to Rule 114(2) EPC dated Oct. 22, 2014, European Patent Application No. 12758588.3, Observations Pursuant to Article 115 EPC.
European Patent Application No. 12758588.3, Further Examination Report dated Nov. 26, 2014.
Communication from EP Intellectual Property Office dated Jul. 11, 2013, Observations pursuant to Section 21 of the Patents Act 1977, to be published by the USPTO.
Intellectual Property Office, Third Party Observations regarding Application No. GB1302462.5, Jan. 6, 2015, 6 pages.
European Search Report, Application No. EP 13 19 2034, dated Mar. 25, 2014, 6 pages.

* cited by examiner

TAPE DRIVE AND METHOD OF OPERATION OF A TAPE DRIVE

CROSS REFERENCE TO RELATED APPLICATIONS

This application claims the benefit of priority (under 35 USC 119) of UK Patent Application No. 1220180.2, filed 9 Nov. 2012.

BACKGROUND

This invention relates to a tape drive, a method of operating such a tape drive and a printing apparatus including such a tape drive.

The invention is particularly useful in relation to a printing apparatus which utilises a printing tape or "ribbon" which includes a web carrying marking medium, e.g. ink, and a printhead which, in use, removes marking medium from selected areas of the web to transfer the marking medium to a substrate to form an image, such as a picture or text.

More particularly, but not exclusively, the invention relates to a so called thermal transfer overprinting apparatus in which the printhead includes a plurality of thermal heating elements which are selectively energisable by a controller during printing to warm and soften pixels of ink from the tape and to transfer such pixels to the substrate. The printhead presses the tape against the substrate such that the pixels of ink contact the substrate before the web of the tape is peeled away, thus transferring the pixels of ink from the tape to the substrate.

A thermal transfer overprinter is used to print on to a product's primary packaging and typically mounts within a packaging machine. The image to be printed is often a date code or other product information which needs to be applied to the product's packaging as close as possible to the time at which the product was packaged. The tape drive is used to move and position the thermal transfer tape.

In order to avoid wasting ink, whilst maintaining acceptable print quality, it is advantageous to be able accurately to control the movement of the tape, so as to position the next portion of tape to be used directly adjacent a portion of the tape from which the ink has previously been removed. It is desirable for a spacing between adjacent regions of tape from which pixels are removed to create an image, to be less than 1 mm.

It is also important to ensure that the regions of tape from which ink is removed during successive printing operations do not overlap, so that the printhead does not attempt to remove ink from the same region of the tape more than once. However, it is known to interlace images, such that a previously used region of tape is reused, but in the second and/or subsequent printing operations, different pixels of ink are removed from the tape to create an image.

It is known to provide thermal transfer printing apparatus in two different configurations. In the first, so called "intermittent" configuration, the substrate to be printed and the tape are held stationary during a printing operation, whilst the printhead is moved across the area of the substrate to be printed. Once the printing operation is complete, the printhead is lifted away from the tape, and the tape is advanced to present a fresh region of tape to the printhead for the next printing operation.

In the second, so called "continuous" configuration, the substrate to be printed moves substantially continuously and the tape is accelerated to match the speed of the tape before the printhead is brought into thermal contact with the tape and the printing operation is carried out. In this configuration, the printhead is maintained generally stationary during each printing operation.

In the case of a printing apparatus in continuous configuration, it is also necessary to accurately control the speed of the tape, to ensure that it matches the speed of the substrate. A typical thermal transfer printer operates with substrate that advances at linear speeds between approximately 0.01 meters per second and approximately 2 meters per second. Typical substrate accelerations are up to approximately 12 meters per second per second.

Printing apparatus of the kind described above includes drive apparatus for moving the tape relative to the printhead, to present fresh tape, from which pixels of ink are yet to be removed, to the printhead, such that successive printing operations can be carried out. It has long been known to provide tape drives which include two spool supports, one of which supports a supply spool on which unused tape is initially wound, and the other of which supports a take-up spool, onto which the tape is wound after it has been used. Tape extends between the spools in a tape path. Each of the spool supports, and hence each of the spools of tape, is drivable by a respective motor.

It is known to provide various types of tape drive which are compatible with thermal transfer overprinters. For example, it is known to provide a pair of stepper motors, each of which controls the movement of one of the spools so as to advance tape between the spools in a desired direction. It is also known to provide a single stepper motor which controls the movement of the take up spool so as to pull tape on to that spool, and a mechanical clutch on the supply spool for setting and maintaining the tension in the tape during use. A motor control system of a tape drive including two brushless DC motors is described in the applicant's United Kingdom patent application number GB1113777.5 and also US Patent Publication No. 2013-0039685.

The tape used in thermal transfer printers is thin. Therefore it is important to ensure that the tension in the tape extending between the two spools is maintained at a suitable value or within a suitable range of tensions, in particular to enable the web to peel cleanly away from the heated ink. Too much tension in the tape is likely to lead to the tape being deformed or broken, whilst too little tension will inhibit the correct operation of the device. A slack tape is likely to affect print quality. It is known to provide a transducer to monitor tape tension, for example a load cell, or position sensor which presses against one side of the tape extending between the two spools. In the event of the tension in the tape reducing, for example if the tape goes slack or breaks, or as a result of tension having become too great, the transducer exhibits a larger than usual change in its output.

SUMMARY

In accordance with the present invention, there is provided a method of detecting a reduction in tension in a tape, wherein the tape is transferable between a first spool and a second spool by a tape drive, the tape drive having a motor control system which includes two DC motors and a controller for controlling the operation of the motors, the tape drive also having two spool supports, each of which is suitable for supporting a spool of tape, and each of which is driven by a respective one of the motors, the method including storing a value relating to the current required to be supplied to each motor to maintain tension in the tape, and comparing a value relating to the current being supplied to each of the motors during tape transfer with the respective stored values.

The motors may be brushless DC motors or other functionally comparable motors. This invention has been developed using brushless DC motors. These motors are known by other names, for example, AC servo motors. The invention is also applicable to motors known as Switched Reluctance motors (both with and without permanent magnets). These motors are all controlled by the use of a software controlled system which generates a rotating magnetic field, and as such are functionally comparable with one another.

Using knowledge of the currents supplied to the motors to determine whether tension in the tape has reduced below an acceptable threshold is advantageous because it is unnecessary to use additional transducers to monitor tape tension.

In the event that at least one of the values relating to current being supplied to the motors during tape transfer is lower than the respective stored value, the motor control system may indicate that the tension in the tape has reduced.

Each of the motors may be operable in a first control mode and a second control mode, and the method may include, when the tape is substantially stationary, operating one motor in the first control mode whilst the other motor operates in the second control mode, to maintain tension in the tape. The first control mode may be a position control mode and the second control mode may be torque control mode.

The method may include storing a value relating to the current required to be supplied to each motor in order to maintain tension in the tape, whilst one of the motors is operating in the first control mode and the other motor is operating in the second control mode.

The method may include switching the motor which was in the second control mode whilst the tape was stationary into the first control mode to transfer tape between spools.

The motor control system may disregard fluctuations in at least one of the values relating to the current being supplied to the motors which occur for a time which is shorter than a predetermined threshold. This avoids false indications of a reduction in tape tension which could be caused by fluctuations in current supplied to the motors which may occur as the motor control system attempts to maintain the positions of the motors.

According to a second aspect of the invention, there is provided a method of detecting breakage of a tape wherein the tape is transferable between a first spool and a second spool by a tape drive, the tape drive having a motor control system which includes two DC motors and a controller for controlling the operation of the motors, the tape drive also having two spool supports, each of which is suitable for supporting a spool of tape, and each of which is driven by a respective one of the motors, the method including detecting breakage of the tape by means of monitoring the movement of at least one of the motors.

Each motor may have an associated sensor and the method may include operating one of the motors in the first control mode and the other motor in the second control mode, so as to maintain a tape stationary, wherein in the event that the controller receives an input from the sensor relating to the second motor, which indicates that the second motor is continuously rotating, the motor control system may indicate that the tape is broken.

According to a third aspect of the invention, there is provided a method of operating a tape drive for transferring tape between a first spool and a second spool, the tape drive having a motor control system which includes two DC motors and a controller for controlling the operation of the motors, the tape drive also having two spool supports, each of which is suitable for supporting a spool of tape, and each of which is driven by a respective one of the motors, each of the motors being operable in a first control mode and a second control mode, the method including storing a value relating to the current required to be supplied to each motor in order to maintain tension in the tape whilst one of the motors is in the first control mode and the other motor is in the second control mode, comparing values relating to the current being supplied to each of the motors during tape transfer, whilst both motors are in the first control mode, with the respective stored values, and in the event that at least one of the values relating to current being supplied to the motors is lower than the respective stored value, the motor control system operates one of the motors in the first control mode and the other of the motors in the second control mode, so as to maintain the tape stationary, and in the event that the controller receives an input from the sensor relating to the motor operating in the second control mode, which indicates that the motor operating in the second control mode is continuously rotating, the motor control system provides a signal that indicates that the tape has broken.

According to a fourth aspect of the invention there is provided a tape drive for transferring tape between a first spool and a second spool, the tape drive having a motor control system which includes two DC motors, and a controller for controlling the operation of the motors, the tape drive also having two spool supports, each of which is suitable for supporting a spool of tape, and each of which is driven by a respective one of the motors, wherein the motor control system is operable in accordance with a method according to any one of the first, second and third aspects of the invention.

Each of the motors may be operable in a first control mode and a second control mode.

The first control mode may be a position control mode. The position control mode may be a position control mode with a torque bias.

The second control mode may be a torque control mode.

The controller may control operation of both of the motors such that each motor may be switchable between the first control mode and the second control mode.

Each of the motors may have an associated sensor and each sensor may enable the controller to determine the position and velocity of a rotor of the respective motor. Each sensor may be a rotary encoder.

The switch between the first control mode and the second control mode may be a smooth transition.

According to a fifth aspect of the invention, there is provided a printing apparatus including a tape drive in accordance with the fourth aspect of the invention. The printing apparatus may be a thermal transfer printing apparatus.

BRIEF DESCRIPTION OF THE DRAWINGS

The invention will now be described, by way of example only, with reference to the accompanying drawings, of which.

DETAILED DESCRIPTION

Figure 1:
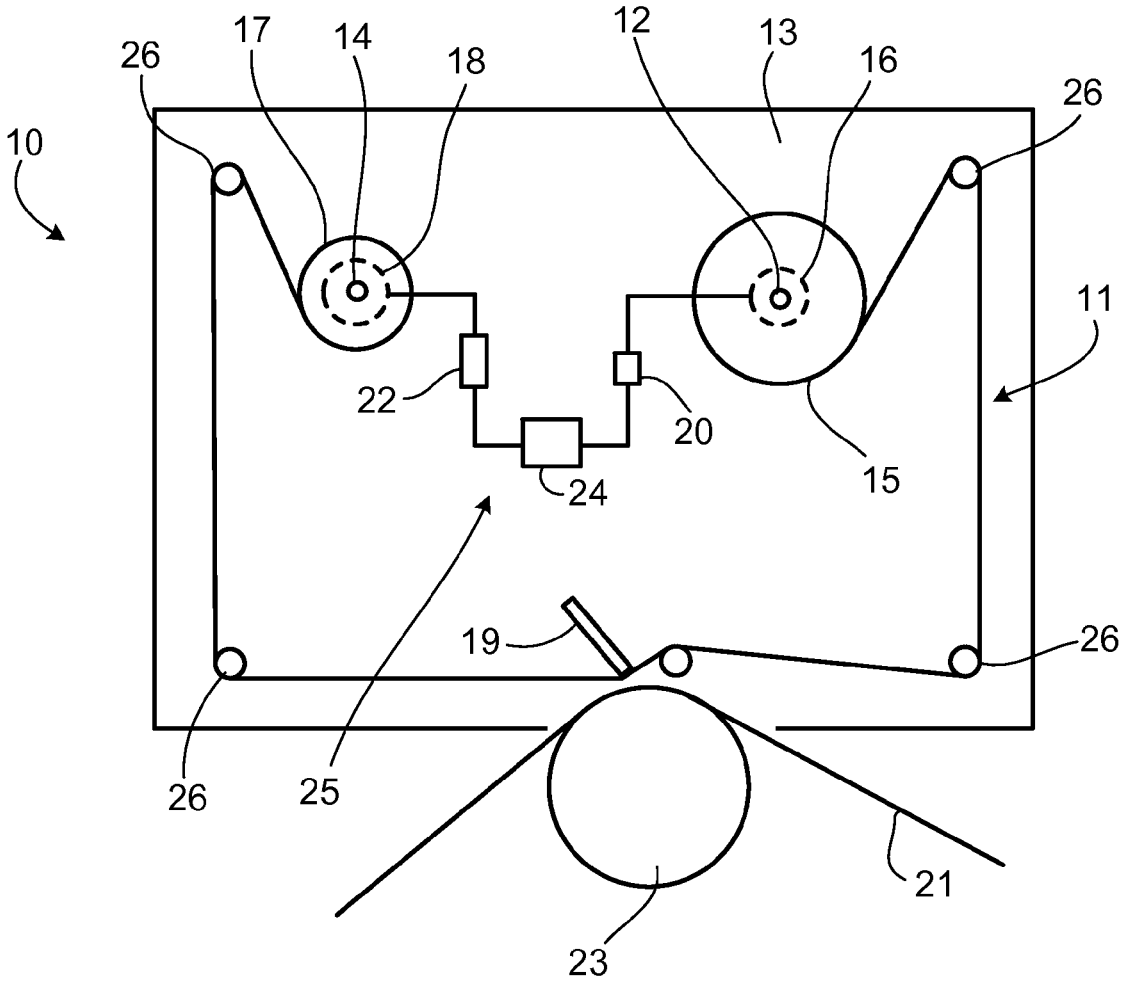
FIG. 1 is an illustrative view of part of a thermal printing apparatus including a tape drive according to the present invention.
Figure 2:
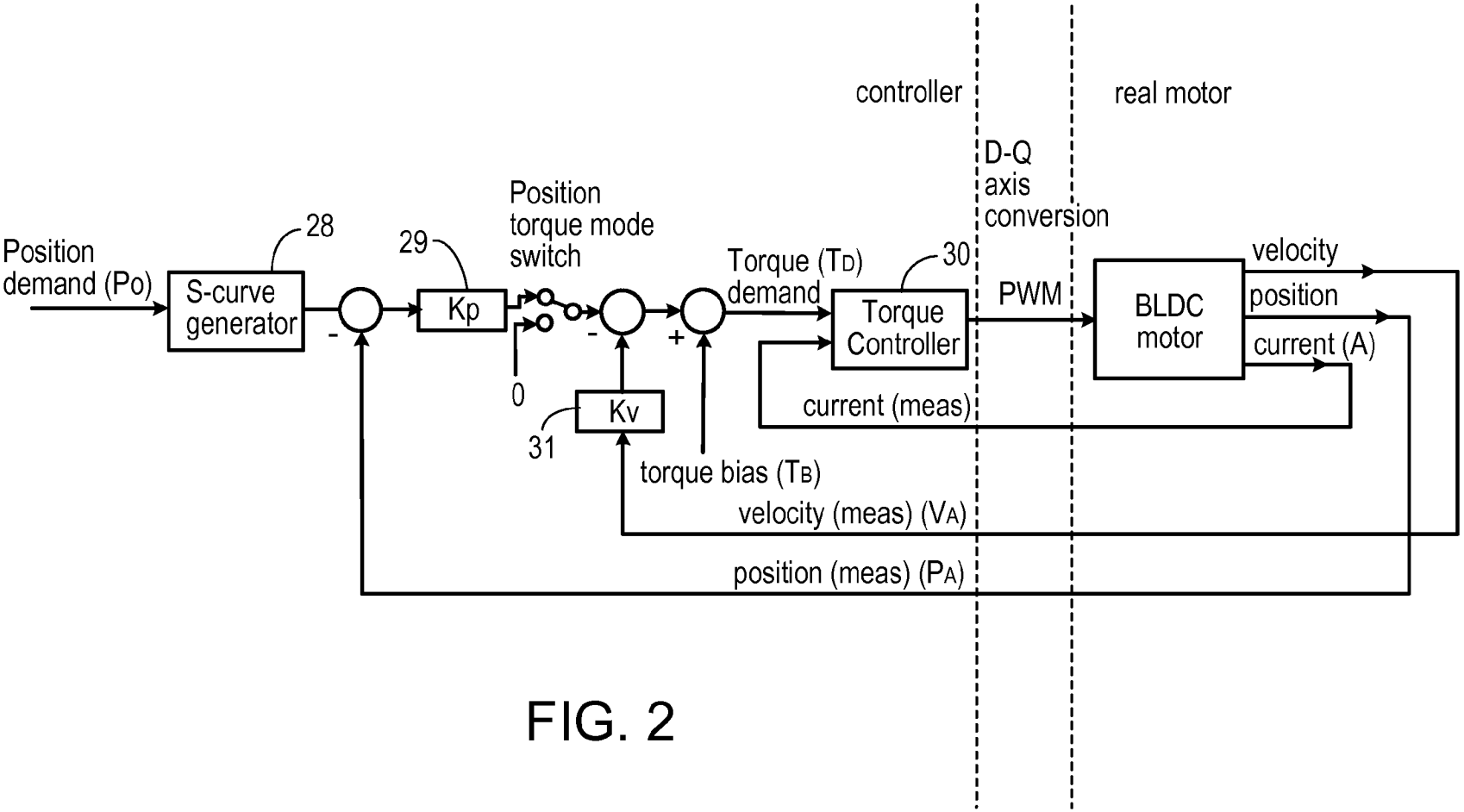
FIG. 2 is an illustrative view of a feedback circuit of the motor control system.
Figure 3:
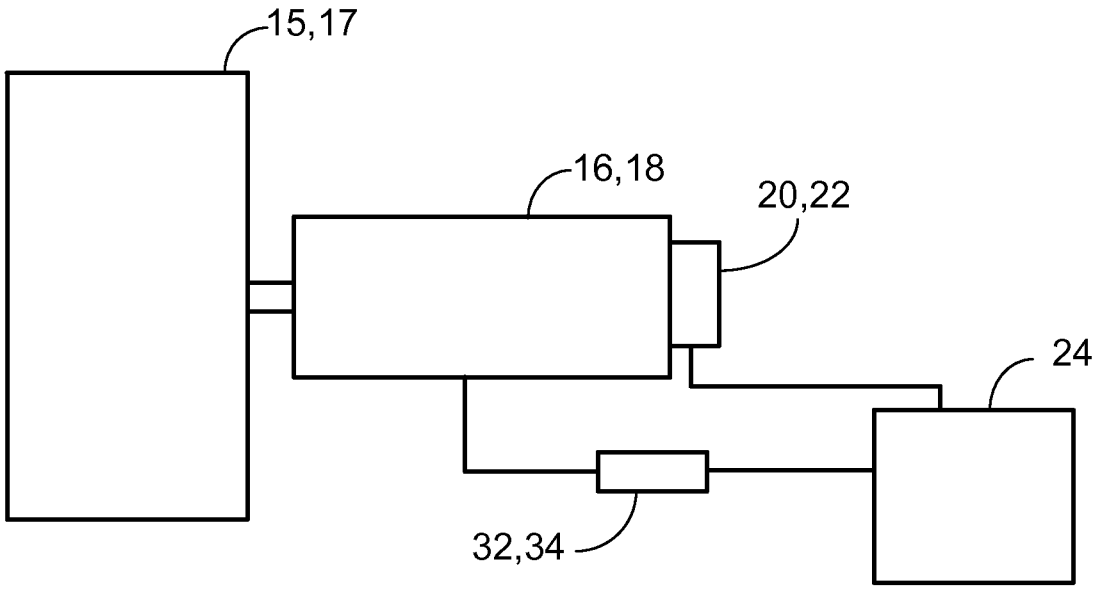
FIG. 3 is an illustrative side view of a motor control system.
Figure 4:
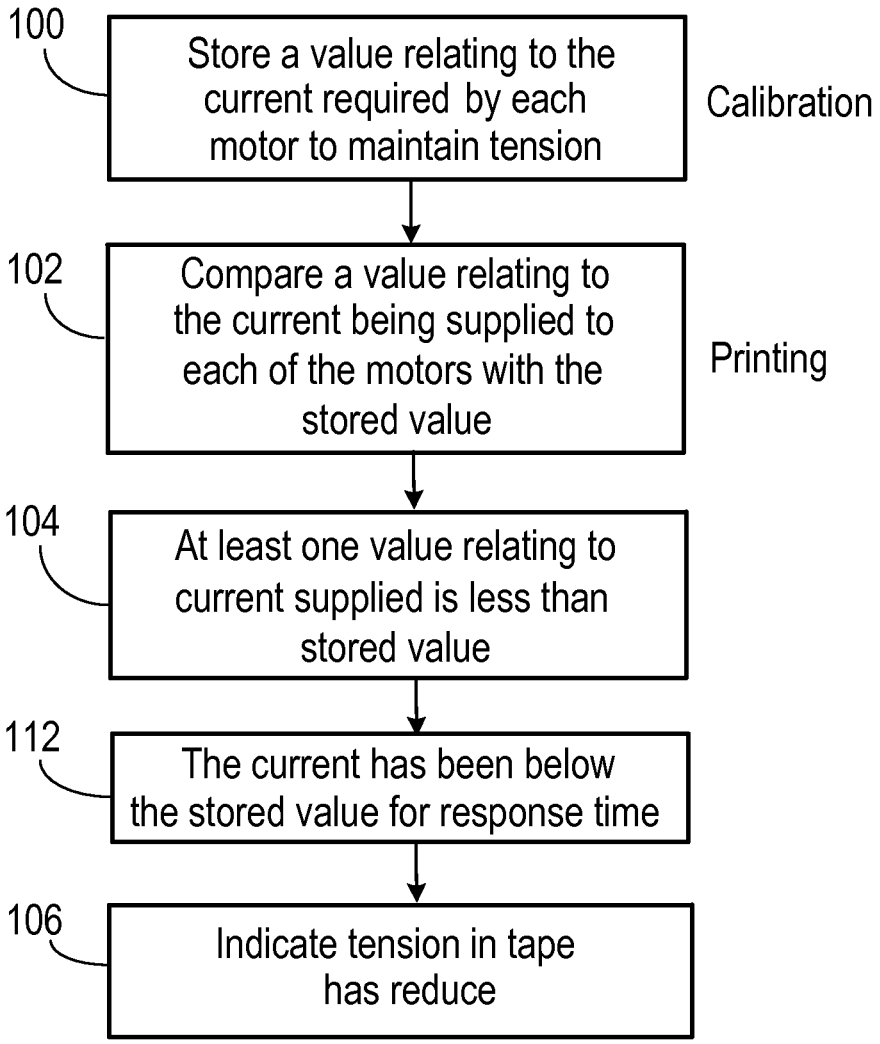
FIGS. 4,5 and 6 are flow diagrams showing a method of operation according to some implementations of the invention.
Figure 5:
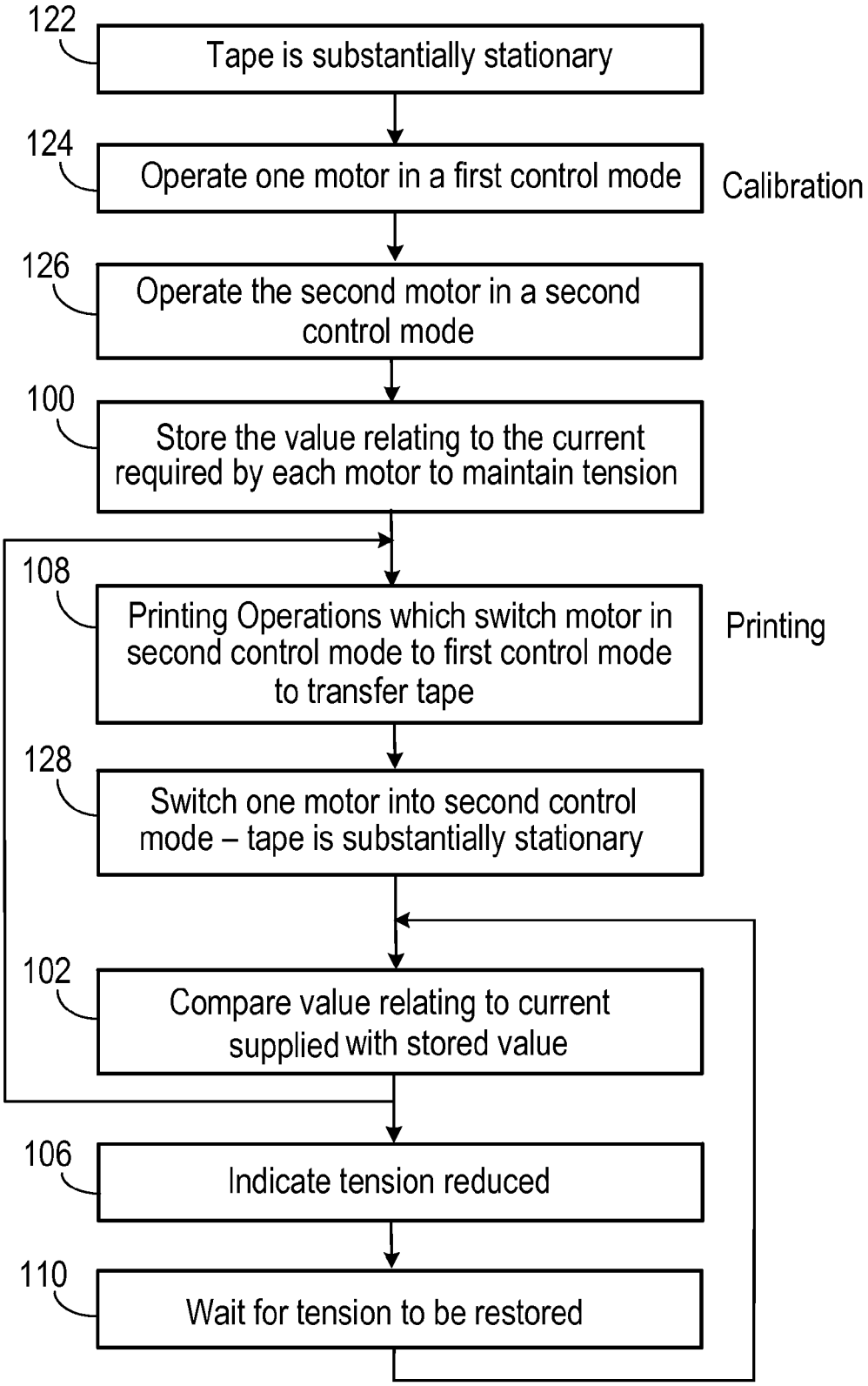
Figure 6:
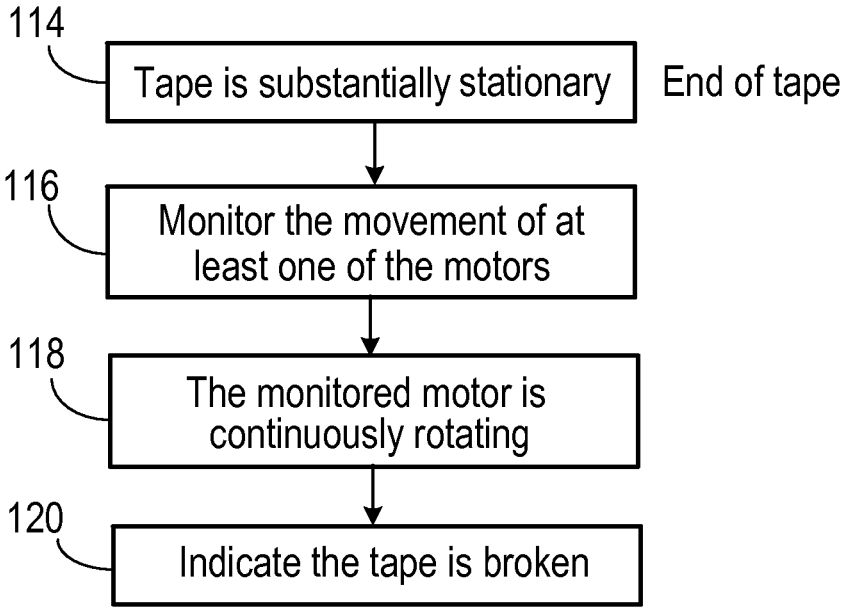

Referring to FIG. 1, there is shown a part of a printing apparatus 10. The printing apparatus 10 includes a tape drive shown generally at 11. The printing apparatus includes a housing 13, in or on which is mounted a first spool support 12 and a second spool support 14, which form part of the tape drive 11. A spool of tape 15, 17, for example inked printer tape, is mountable on each of the supports 12, 14. The spool supports 12, 14 are spaced laterally from one another. The printing apparatus 10 also includes a printhead 19 for transferring ink from the tape to a substrate 21 which is entrained around a roller 23 adjacent the printhead 19. Depending upon the configuration of the printer, the substrate 21 may be positioned adjacent the printhead 19 on a platen, rather than a roller.

Each of the spool supports 12, 14 is independently drivable by a respective motor 16, 18. Each of the motors 16, 18 is a brushless DC motor. However, it will be understood that other functionally comparable motors could be used, for example Switched Reluctance motors (both with and without permanent magnets). The use of the terms "DC motor" and "brushless DC motor" herein is intended to include such functionally comparable motors.

Each of the spool supports 12, 14 is rotatable clockwise and anti-clockwise by means of its respective motor 16, 18. The movement of each motor 16, 18 is controlled and monitored by a controller 24 via a sensor 20, 22. The position of the controller 24 relative to the remainder of the printing apparatus 10 is irrelevant for the purposes of the present invention. The sensors 20, 22 typically are rotary encoders although it will be appreciated that other technologies are acceptable. The controller 24 is operable to control the mode of operation of each of the motors 16, 18 and the amount of drive provided by each of the motors 16, 18. Each sensor 20, 22 enables the controller 24 to determine the angular position and rotational speed of a rotor of the respective motor 16, 18.

The motors 16, 18, the sensors 20, 22 and the controller 24 all form part of a motor control system 25. The motor control system 25 allows the drive of each motor 16, 18 to be controlled such that each motor is switchable (128) between a first control mode (124) wherein position is a dominant control parameter and a second control mode (126) where torque is the dominant control parameter. The first control mode will be referred to herein as "position control mode" and the second control mode will be referred to as "torque control mode". In position control mode, the motor 16, 18 is driven to a demanded position and in torque control mode, the motor 16, 18 outputs a demanded torque. The control system 25 enables a user to adjust the proportion of torque control and the proportion of position control which is applied by each motor 16, 18. Each motor drive can be adjusted smoothly from fully position controlled to fully torque controlled and back again. Such a motor control system is described in the applicant's United Kingdom patent application number GB1113777.5, filed on 10 Aug. 2011 and in its U.S. patent application Ser. No. 13/237,802, filed on 20 Sep. 2011, and published as US Patent Publication No. 2013-0039685, the contents of which are incorporated herein by reference.

In more detail, the controller 24 receives inputs relating to a demanded position of each motor 16, 18 to advance the tape to a required position, the actual position of the motor 16, 18, the measured velocity of each motor 16, 18, the current drawn by the motor 16, 18, and a torque bias $T_B$ required by the motor 16, 18 at a given point in time. The purpose of the torque bias $T_B$ will be described in greater detail below.

In use, a supply spool 17, upon which unused tape is wound, is mounted on the spool support 14, and a take up spool 15, upon which used tape is wound, is mounted on the spool support 12. The tape generally advances in a tape path between the supply spool 17 towards the take up spool 15. The tape is guided in the tape path between the spools 15, 17 adjacent the printhead 19 by guide members 26.

The tape drive 11 requires calibration before printing operations can commence. Such calibration is generally required when the printing apparatus 10 is switched on, and when the spools of tape 15, 17 are replaced. The calibration process includes determining an initial estimate of the diameters of each of the spools of tape 15, 17 mounted on the spool supports 12, 14. An example of a suitable method of obtaining such an estimate is described in detail in the applicant's patent GB2310405. As tape passes from one spool to the other, for example from the supply spool 15 to the take up spool 17, it passes over a roller of known diameter. The roller is preferably one of the guide members 26. Tape is drawn from the supply spool 17, with the motor 16 which drives the take-up spool support 12 operating in position control mode. The motor 18 which drives the supply spool support 14 operates in torque control mode to deliver a predetermined torque.

During the calibration process, the current supplied to each of the motors 16, 18 is monitored and information relating to the current drawn by each motor 16, 18 is provided to the controller 24. The motor controller 24 monitors the current supplied to each motor 16, 18 via a respective current sensor 32, 34 connected between a driver of each motor 16, 18 and the motor 16, 18 itself. This process will be explained in greater detail below.

Following the calibration process, the motor control system 25 maintains and updates values for the diameters of the spools 15, 17 by monitoring the amount of tape transferred from the supply spool to the take-up spool. The controller 25 takes into account the thickness of the tape to compute an expected change in the diameters of the spools 15, 17 over a period of time. This technique relies on the tension in the tape being kept substantially constant during printing operations and advancement of the tape between the spools 15, 17.

When the tape is at rest, the motor control system 25 maintains the desired tape tension by operating one motor, for example the supply spool motor 18, in position control mode. The other motor, for example the take up spool motor 16, is operated in torque control mode.

The motor 18 ensures that the absolute position of the tape relative to the printhead is accurately controlled, whilst the other motor 16 maintains the tension in the tape at the desired predetermined value.

In order to achieve this, a demanded position $P_D$ of the motor 18 is received by an S-curve generator 28, an output of which is used, along with an actual position $P_A$ of the motor 18 in an algorithm, preferably a PID algorithm, applied by an electronic filter 29 to determine the change in position required to be carried out by the motor 18. An actual velocity $V_A$ of the motor 18 is input to a second electronic filter 31, which performs an algorithm, again preferably a PID algorithm, and an output of the second electronic filter 31 is used in conjunction with an output of the first electronic filter 29, relating to the change in position of the motor 18, to determine a demanded torque $T_D$ to be provided by the motor 18. A demanded torque $T_D$ and the amount of current A drawn by the motor 18 are fed back to a torque controller 30 to provide a control output to the motor 18. Although the algorithms implemented by the filters 29, 31 are described as being PID algorithms, it will be appreciated that any Linear Time Invariant filter function may be used.

The motor 16 being operated in torque control mode does not use inputs relating to demanded position $P_D$ or actual position $P_A$ of the motor 16. The inputs relating to actual velocity $V_A$ may also be disregarded. The torque controller 30 receives a torque demand $T_D$ based only on the torque bias $T_B$, and optionally upon the actual velocity $V_A$ of the motor 16. The current A of the motor 16 may also be fed back to the torque controller 30 to generate a control output for the motor 16. The intention of the torque bias $T_B$ is to apply a torque offset to the motor 18, which is in position control mode, to completely counteract the constant torque provided by the other motor 16, which is in torque control mode. This then means that the motor 18 in position control mode is only required to produce an instantaneous torque which will hold that motor in position, and does not need to compensate for the torque applied by the other motor 16. So if, for example, the motor 16 in torque control mode is applying 3N to the tape, the motor 18 in position control mode will have a torque bias $T_B$ applied to generate the equivalent of 3N to balance the tension in the tape.

When the tape is required to be advanced between the spools 15, 17, the controller 25 causes both of the motors 16, 18 to operate in position control mode. The transition of the motor 16, which was previously operated in torque control mode, into position control mode is smooth. This transition from torque control mode to position control mode is carried out by gradually reducing the torque bias $T_B$ to a nominal value, which may be zero.

During tape advance, the two motors 16, 18 advance the tape accurately along the tape path past the printhead 19, using the values of the diameters of the spools 15, 17 and a co-ordinated moving target position. The co-ordinated moving target position is arrived at by the control system 25 determining a desired position of the tape at a point in time, and the controller 24 controls the motors 16, 18 to achieve this desired position of the tape.

Once the advancement of the tape has been completed, one of the spool motors 16, 18, for example the take up spool motor 16, smoothly transitions from position control mode to torque control mode, whilst the other spool motor, for example the supply spool motor 18, remains in position control mode. Gradually increasing the torque bias $T_B$ from zero during deceleration of the tape causes a smooth transition of the motor 16 from position control mode to torque control mode, before the inputs relating to position $P_A$, $P_D$ are disregarded. The other motor, in this case the supply spool motor 18, remains in position control mode, however the value of torque bias $T_B$ applied to this motor may be adjusted, so as to compensate for the increase in torque which is likely to be caused as a result of switching the take up spool motor 16 into torque control mode. In practice, it may be possible to retain a constant torque bias $T_B$ irrespective of whether the motors 16, 18 are stationary or in motion, however, the desired torque bias $T_B$ will be such that it causes the tension in the tape to remain substantially constant, by the two motors 16, 18 applying equal and opposite forces on the tape.

It is desirable, during tape advance, for the amount of tape fed into the tape path from the supply spool 17 to be equal to the amount of tape taken up by the take up spool 15, in order to maintain the tape tension substantially constant. However, this is difficult to achieve in known tape drives because disturbances of the tape which occur during printing operations and the fact that the spools 15, 17 are not perfectly cylindrical, mean that the control of the motors 16, 18 is based upon inaccurate estimates, and thus the tension is unlikely to be kept as near to constant as desired. In the present invention, the smooth transition of the take up motor 16 from position control mode to torque control mode prevents the accumulation of such errors increasing long term drift in the tape tension.

The motor control system 25 is capable of testing the accuracy of its control of the advancement of the tape in two ways.

The first method of testing is to determine the ratio of the torques applied to the two motors 16, 18 when the tape drive 11 is stationary. In such a situation, one motor 16, 18 is stationary, whilst the other motor 16, 18 supplies a torque so as to maintain its position, and to maintain the tension in the tape. The ratio of the torques should be the same as the ratio of the diameters of the spools 15, 17 at that time.

The second method of testing is carried out as the tape drive 11 is completing a movement of the tape. As the take up spool motor 16 transitions from position control mode to torque control mode, the controller 24 monitors the angular position change of take up spool motor 16 between its expected target position and its rest position at the correct ribbon tension, using the sensor 20. The angular position change that occurs together with the spool diameter gives a measure of the disturbances and errors in the position control of the motor 16.

The operation of the control system 25 is iterative, in that it takes into account the results of the testing method(s) carried out over a number of tape advancements (printing cycles) to correct the estimate of the diameters of the spools 15, 17 for future printing cycles.

The method of operation of the tape drive 11 described above retains the supply spool motor 18 in position control, as the supply spool 17 is more likely to be cylindrical than the take up spool, the tape on the supply spool 17 not having been unwound, and ink removed from it before being rewound on a different spool. Therefore this mode of operation is more likely to provide accurate positioning of the tape adjacent the printhead 19. However, it will be appreciated that either spool motor 16, 18 could be switched to torque control mode during tape advance.

During normal operation of the tape drive 11, the two motors 16, 18 effectively pull against one another to create and maintain tension in the tape which extends between the spools 15, 17. Whilst tension is maintained substantially constant, or at least within acceptable limits, it is desirable to be able to detect instances of loss of tension and/or tape breakage, should they occur.

In order to detect loss of tension in the tape extending between the spools 15, 17, and to detect tape breakage, either during advancement of the tape between one spool 15, 17 and the other, or when the tape is at rest (122), the controller 24 of the motor control system 25 stores a value (100) relating to the current required by each motor 16, 18, respectively, to maintain acceptable tension in the tape. This is carried out as part of the calibration process, as mentioned above. Acceptable tension in the tape of a thermal transfer overprinter is generally between 2N and 8N and is preferably approximately 3N. The controller 24 is able to determine when the tension in the tape has reached an acceptable level during the calibration process as the relationship between current supplied, torque provided and tension in the tape is known. This relationship is dependent upon the type of motor being used. A transfer function is used to convert the required currents into values which are stored and used by the controller 24.

In the event that tension in the tape reduces below an acceptable threshold, i.e. lower than a lower acceptable limit, a motor 16, 18 which is in position control mode will require less current to achieve or maintain its target position.

The current provided to each motor 16, 18 is controlled by the controller 24 and is based upon the desired position of the motor 16, 18, which is determined by the respective sensor 20, 22, the actual position of the motor 16, 18, which is again determined by the respective sensor 20, 22, and the currents in each motor winding. The controller 24 receives an input from the current sensors 32, 34 between each of the motor drivers and the windings of each of the motors 16, 18, each input showing the current being drawn by the respective motor 16, 18. The controller 24 compares (102) each input with the stored value (100) relating to the current required by each motor 16, 18 to maintain tension in the tape. In the event that the desired and actual sensor outputs (encoder positions) of a motor 16, 18 in position control mode are the same, i.e. the motor is in the correct position, and the amount of current being supplied to the motor 16, 18 is less than is indicated as being necessary (104) by the stored value (100), then the controller 24 provides a signal (106) that the tension in the tape has fallen or is about to fall below an acceptable threshold (limit) and prevents further printing operations from being carried out. Maintaining one of the motors 16, 18 at rest in position control mode, and operating the other motor 16, 18 in torque control mode enables the tension in the tape to be increased (110) back up to an acceptable level. When the current supplied to each motor 16, 18 matches current required to maintain tension, as determined during the calibration process, the controller 24 permits printing operations to be resumed (108).

There are occasions during use of the tape drive 11 that the control system 25 will perceive a momentary drop in current supplied to one or both of the motors 16, 18 before the current returns to a value which maintains tension in the tape. This is as a result of the control system 25 attempting to keep the motor 16, 18 in position (either stationary or moving) and over-compensating. In such a situation, the motor 16, 18 will move beyond the desired position, and it is necessary to reduce or reverse the current being supplied to that motor 16, 18 which will allow the tension in the tape to pull the motor 16, 18, and hence the associated spool 15, 17, back to the desired position. This position correction takes place within the response time of the control system 25, which is typically in the order of microseconds. The control system 25 needs to be able to discern between momentary drops in current drawn by a motor 16, 18 and a drop in current which is associated with a reduction in tension in the tape. A means of doing this is to filter current samples which are provided to the controller 24. The response time of the filter must be small enough to allow the control system 25 to react quickly enough to drops in current supplied to a motor 16, 18, so as to prevent further printing operations from beginning, but short enough to neglect momentary drops in current demand which result from position correction (112). A typical response time for a filter for a thermal transfer overprinter is 125 milliseconds.

A second situation that can occur is tape breakage, which can be caused by the tension in the tape having exceeded an upper limit. It is advantageous to be able to detect when the tape has broken, so as to halt printing operations to allow the tape to be repaired or, more likely, replaced. When the tape drive 11 is at rest (114), between printing operations, at least one of the motors 16, 18 is operating in torque control mode. If no tape is extending between the spools 15, 17, the or each motor 16, 18 which is operating in torque control mode will continuously rotate. Of course, if the tape has broken, the tape will no longer extend between the spools. The sensor 20, 22 associated with the motor 16, 18 in torque control mode will indicate to the controller 24 that the motor 16, 18 is continuously rotating (116, 118). The controller 24 provides an indication (120) to a user that the tape is likely to have broken, for example by means of a visible and/or audible indication.

The motor control system 25 ideally combines the results of the two tests described above to indicate a tape breakage. Reduction in (or complete loss of) tension can be, and preferably is, detected first, depending upon the response time parameters of the filters, so further printing operations are stopped. If the tape has broken, the motor 16, 18 in torque control mode will spin at a rotational velocity dictated by the torque demanded from the motor 16, 18 at the point of tape breakage and the mass of the spool 15, 17 being driven by the motor 16, 18 in torque control mode. The spool 15, 17 being driven by the motor 16, 18 in torque control mode may rotate through a full revolution before the control system 25 determines that the tape has broken rather than being slacker than desired.

When power is removed from the motors 16, 18, the control system 25 manages the tension of the tape in the tape path. If the tape is in tension when power is removed from the motors 16, 18, one or both of the spools 15, 17 will be accelerated by the force exerted by the tension in the tape. Even when the tape is no longer in tension, the or each spool 15, 17 which has been accelerated will continue to rotate owing to the momentum of the spool(s) 15, 17, and tape may spill from the printing apparatus 10. Of course, this is undesirable, and unacceptable. To overcome this problem, the control system 25 operates at least one of the motors 16, 18, so as to enable a controlled release of tension from the tape, before power is removed from the motors 16, 18. Alternatively, a mechanical device may be used to inhibit or prevent the acceleration of the spools 15, 17 upon removal of power from the motors 16, 18.

Whilst the invention has been described in relation to thermal printing apparatus, it will be appreciated that the motor control system may be utilised in relation to other devices or apparatus.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A method of detecting a reduction in tension in a tape, wherein the tape is transferrable between a first spool and a second spool by a tape drive, the tape drive having a motor control system which includes two DC motors and a controller for controlling the operation of the motors, the tape drive also having two spool supports, each of which is suitable for supporting a spool of tape, and each of which is driven by a respective one of the motors, the method including storing a value relating to the current required to be supplied to each motor to maintain tension in the tape, and comparing a value relating to the current being supplied to each of the motors during tape transfer with the respective stored values.

2. A method of detecting reduction in tension in a tape according to claim 1, wherein in the event that at least one of the values relating to current being supplied to the motors during tape transfer is lower than the respective stored value, the motor control system indicates that the tension in the tape has reduced.

3. A method of detecting reduction in tension in a tape according to claim 1, wherein each of the motors is operable in a first control mode and a second control mode, the method including, when the tape is substantially stationary, operating one motor in the first control mode whilst the other motor operates in the second control mode, to maintain tension in the tape.

4. A method of detecting reduction in tension in a tape according to claim 3, including storing the values relating to the current required to be supplied to each motor in order to maintain tension in the tape, whilst one of the motors is operating in the first control mode and the other motor is operating in the second control mode.

5. A method of detecting reduction in tension in a tape according to claim 3, including switching the motor which was in the second control mode whilst the tape was stationary into the first control mode to transfer tape between spools.

6. A method of detecting reduction in tension in a tape according to claim 2, wherein the motor control system disregards fluctuations in at least one of the values relating to the current being supplied to the motors which occur for a time which is shorter than a predetermined threshold.

7. A tape drive for transferring tape between a first spool and a second spool, the tape drive having a motor control system which includes two DC motors, and a controller for controlling the operation of the motors, the tape drive also having two spool supports, each of which is suitable for supporting a spool of tape, and each of which is driven by a respective one of the motors, wherein the motor control system is operable in accordance with a method according to claim 1.

8. A tape drive according to claim 7, wherein each of the motors is operable in a first control mode and a second control mode.

9. A tape drive according to claim 8, wherein the first control mode is a position control mode.

10. A tape drive according to claim 8, wherein the second control mode is a torque control mode.

11. A tape drive according to claim 8, wherein the controller controls operation of both of the motors such that each motor is switchable between the first control mode and the second control mode.

12. A tape drive according to claim 11, wherein each of the motors has an associated sensor and each sensor enables the controller to determine the position and velocity of a rotor of the respective motor.

13. A tape drive according to claim 11, wherein the switch between the first control mode and the second control mode is a smooth transition.

14. A printing apparatus including a tape drive according to claim 7.

15. A printing apparatus according to claim 14 being a thermal transfer printer.

16. A method of detecting breakage of a tape wherein the tape is transferrable between a first spool and a second spool by a tape drive, the tape drive having a motor control system which includes two DC motors and a controller for controlling the operation of the motors, each motor having an associated sensor, the tape drive also having two spool supports, each of which is suitable for supporting a spool of tape, and each of which is driven by a respective one of the motors, the method including detecting breakage of the tape by monitoring the movement of at least one of the motors, the method including operating one of the motors in the first control mode and the other motor in the second control mode, so as to maintain a tape stationary, and wherein in the event that the controller receives an input from the sensor relating to the second motor, which indicates that the second motor is continuously rotating, the motor control system indicates that the tape is broken.

17. A method of operating a tape drive for transferring tape between a first spool and a second spool, the tape drive having a motor control system which includes two DC motors and a controller for controlling the operation of the motors, the tape drive also having two spool supports, each of which is suitable for supporting a spool of tape, and each of which is driven by a respective one of the motors, each of the motors being operable in a first control mode and a second control mode, the method including storing a value relating to the current required to be supplied to each motor in order to maintain tension in the tape whilst one of the motors is in the first control mode and the other motor is in the second control mode, comparing values relating to the current being supplied to each of the motors during tape transfer, whilst both motors are in the first control mode, with the respective stored values, and in the event that at least one of the values relating to current being supplied to the motors is lower than the respective stored value, the motor control system operates one of the motors in the first control mode and the other of the motors in the second control mode, so as to maintain the tape stationary, and in the event that the controller receives an input from the sensor relating to the motor operating in the second control mode, which indicates that the motor operating in the second control mode is continuously rotating, the motor control system provides a signal that indicates that the tape has broken.

* * * * *